US005136335A

United States Patent [19]

Takeda et al.

[11] Patent Number: 5,136,335

[45] Date of Patent: Aug. 4, 1992

[54] DEVELOPER CARRIER WITH A DIELECTRIC LAYER HAVING A FREQUENCY CHARACTERISTIC CONFINED IN A PREDETERMINED RANGE

[75] Inventors: Fuchio Takeda, Tokyo; Yasuo Hirano, Numazu; Kazuhiro Nishido, Yokohama; Takeo Wada, Tokyo, all of Japan

[73] Assignee: Ricoh Company, Ltd., Tokyo, Japan

[21] Appl. No.: 670,406

[22] Filed: Mar. 15, 1991

[30] Foreign Application Priority Data

Jan. 17, 1989 [JP] Japan ..... 1-7973
Oct. 18, 1989 [JP] Japan ..... 1-271141

[51] Int. Cl.[5] ..... G03G 15/06
[52] U.S. Cl. ..... 355/259; 29/132
[58] Field of Search ..... 355/245, 259; 118/661; 29/110, 132; 428/380, 383

[56] References Cited

U.S. PATENT DOCUMENTS 4,425,382 1/1984 Tajima ..... 29/132 X
4,760,422 7/1988 Seimiya et al. ..... 355/259 X
4,780,743 10/1988 Asada et al. ..... 355/259
4,791,882 12/1988 Enoguchi et al. ..... 118/653
4,827,868 5/1989 Tarumi et al. ..... 29/132 X
4,860,417 8/1989 Tajima et al. ..... 29/132 X
4,899,689 2/1990 Takeda et al. ..... 355/259 X
4,910,556 3/1990 Namiki ..... 118/651 X

FOREIGN PATENT DOCUMENTS 0186767 10/1983 Japan .
0180112 7/1987 Japan .

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A developing device for use in an image forming apparatus and having a developing roller, developing sleeve or similar developer carrier for supplying a one-component developer, or toner, to a latent image which is electrostatically formed on an image carrier such as a photoconductive element. A dielectric layer forming part of the developer carrier and closely related to the fluctuation of developing characteristic has a frequency characteristic which is confined in a predetermined range. Hence, the device is operable in a desirable manner by confining the fluctuation of developing characteristic ascribable to that of developing linear speed in a predetermined range without resorting to the actual measurement of a response characteristic of a developer carrier.

5 Claims, 7 Drawing Sheets

DEVELOPER CARRIER WITH A DIELECTRIC LAYER HAVING A FREQUENCY CHARACTERISTIC CONFINED IN A PREDETERMINED RANGE

This application is a continuation-in-part of application Ser. No. 07/461,000, filed on Jan. 4, 1990, now abandoned.

BACKGROUND OF THE INVENTION

The present invention relates to a developing device for use in an image forming apparatus and having a developing roller, developing sleeve or similar developer carrier for supplying a one-component developer, or toner, to a latent image electrostatically formed on a photoconductive element or similar image carrier.

In an image forming apparatus implemented by an electrophotographic procedure such as a copier, laser beam printer or facsimile machine, a latent image representative of a document is electrostatically formed on a photoconductive element or similar image carrier. The apparatus has a developing device in which a developing roller, developing sleeve or similar developer carrier is accommodated. The developer carrier supplies one-component developer, i.e., toner to the latent image to develop the latent image on the photoconductive element. A developer supplying member in the form of a roller, for example, is held in contact or located in close proximity to a developer supplying region of the developer carrier. A regulating member implemented as a blade or a roller regulates the thickness of a developer layer formed on the developer carrier and is held in contact with the developer carrier in a regulating region which is defined downstream of the developer supplying region. In the developer supplying region, the developing supplying member supplies a fresh toner from a toner storing section to the developer carrier. The toner deposited on the image carrier is leveled by the regulating member to form a layer having a predetermined small thickness. The regulated toner layer is fed into a developing region located downstream of the regulating region to be selectively supplied to the latent image.

The developer carrier in the form of a roller or a sleeve is made up of a conductive base and a dielectric layer formed on the base for adjusting the electric field for development. The developer carrier is pressed against the photoconductive element or similar image carrier in order to free the developing device from the need for accurate positioning control. The dielectric layer is generally implemented by a material having elasticity such as polyester urethane or similar urethane-based composition. A problem with a prior art developing device having such a developer carrier is that the developing characteristic is susceptible to developing linear velocity which is determined by the relationship between the moving speed of the image carrier and that of the developer carrier, degrading the developing quality. Specifically, in an ordinary developing device, a predetermined electric field for development is set up in the developing region defined between the image carrier and the developer carrier, whereby a force acts on the charge deposited on the toner particles existing in the developing region. Whether or not the toner particles are allowed for development is dependent on the intensity of the force acting on the charge as mentioned above. The materials constituting the developer carrier, especially the material of the dielectric layer, have great influence on the electric field in the developing region. Specifically, the electric field noticeably fluctuates when the dielectric layer of the developer carrier is implemented by polyurethane or similar urethane-based composition or any other material whose dielectric relaxation characteristic is poor. In such a condition, the developing characteristic is critically effected to prevent the developing device from performing desirable development constantly.

SUMMARY OF THE INVENTION

It is therefore an object of the present invention to provide a developing device for an image forming apparatus whose developing characteristic is immune to the fluctuation of developing linear velocity.

It is another object of the present invention to provide a generally improved developing device for an image forming apparatus.

In accordance with the present invention, in a developing device for an image forming apparatus which comprises a developer carrier having a dielectric layer for forming an electric field for development and causes the developer carrier to retain and convey a developer to a developing region where a latent image electrostatically formed on an image carrier is to be developed by the developer, the dielectric layer constituting the developer carrier is formed of a material a frequency characteristic of which is such that a ratio of a maximum specific inductive capacity to a minimum specific inductive capacity in a predetermined frequency range is smaller than a predetermined value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
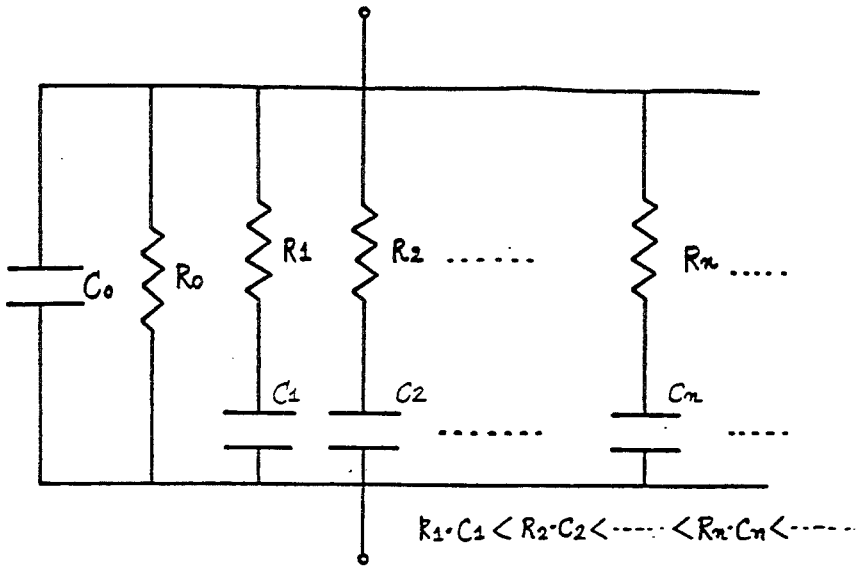
FIG. 1 is a circuit diagram representative of a model of a dielectric.
Figure 2:
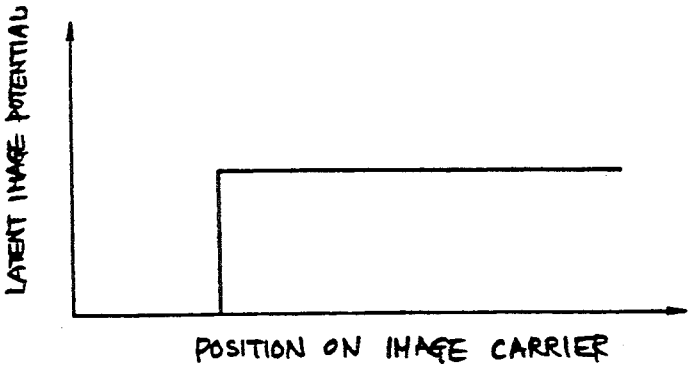
FIG. 2 is a graph showing a relationship between the potential of a latent image and the position on an image carrier.
Figure 3:
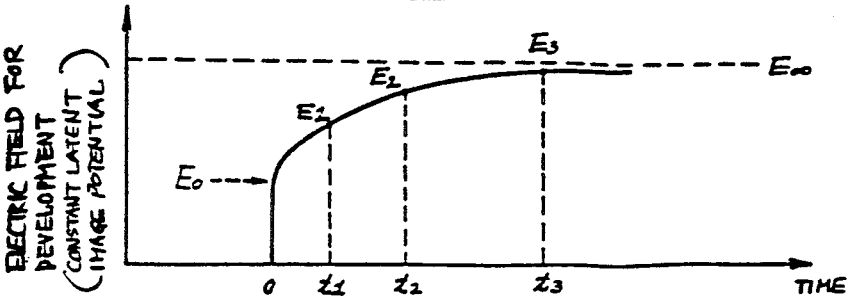
FIG. 3 is a graph showing a variation of an electric field set up in a developing region with respect to time.

To better understand the present invention, a problem with a prior art developing device will be discussed with reference to the accompanying drawings. A developer carrier installed in the prior art developing device and configured as a roller or a sleeve has a conductive base and a dielectric layer, as stated earlier. Since the dielectric layer is made of polyester urethane or similar urethane-based material having elasticity, the developing characteristic is greatly influenced by the developing linear velocity which is dependent on the relationship between the moving speed of the developer carrier and that of an image carrier. FIG. 1 shows a lumped constant type model of a dielectric. In the figure, $C_0$ and $R_0$ are representative of a capacitance component to be charged instantaneously and a resistance component to be measured on the lapse of an infinite period of time, respectively. Also shown in the figure are relaxation components $R_i$ and $C_i$ ($i=1, 2, \ldots$). As shown in FIG. 2, assume that an image carrier having such a dielectric layer has entered the previously mentioned developing region. Then, an electric field for development is formed as shown in FIG. 3. In FIG. 3, $E_0$ represents an electric field derived from the instantaneous charging of the capacitance component $C_0$ shown in FIG. 1, while the variation following the electric field $E_0$ is derived from $C_1R_1$, $C_2R_2$ and so on which are sequentially charged, one having the smallest time constant being first. Assume that use is made of a dielectric in which a relaxation component having substantially the same time constant as the developing time (period of time necessary for the developer carrier to pass the developing region) has substantial influence, compared to the capacitance component $C_0$. Then, when the developing time sequentially changes as represented by $t_1$, $t_2$ and so on in association with the developing linear velocity, the electric field is changed from $E_0$ to $E_1$, $E_2$ and so on, as shown in FIG. 3. This means that the developing characteristic is susceptible to the developing linear velocity. Consequently, the developing characteristic of the prior art developing device is seriously effected because its developer carrier is implemented by polyester polyurethane or similar urethane-based composition or a material, if not based on urethane, whose dielectric relaxation characteristic is poor.

Figure 4:
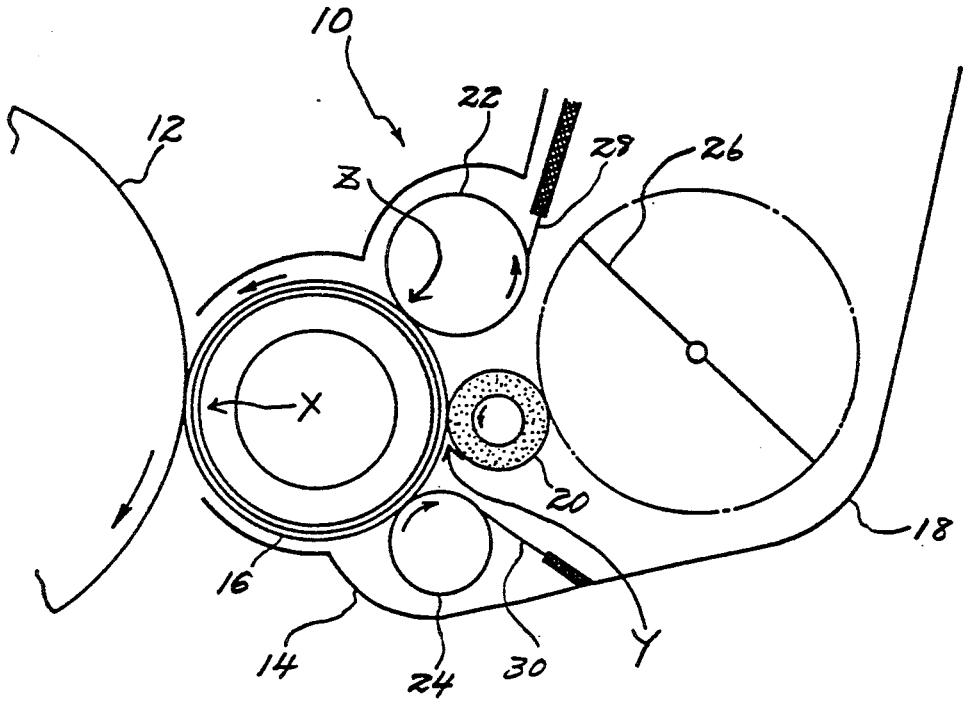
FIG. 4 is a vertical section showing a developing device embodying the present invention.

Referring to FIG. 4, a developing device embodying the present invention is shown and generally designated by the reference numeral 10. The developing device 10 uses a one-component developer, or toner, having high resistance and is located in close proximity to a photoconductive drum 12. The drum 12 is formed of OPC (Organic Photoconductor) or similar material which is to be charged to a predetermined polarity, so that a latent image formed thereon may be developed by a toner which is charged to a predetermined polarity. The developing device 10 has a developing unit 14 in which a developing roller 16, which will be described, is journalled to serve as a developer carrier. The developing roller 16 is elastically urged against the surface of the drum 12. The drum 12 and the roller 16 are rotated in opposite directions to each other, i.e., in the same direction as each other in their contacting portion, as indicated by arrows in the figure. A developing region X is defined in the contacting portion of the drum 12 and roller 16. A toner hopper 18 stores a fresh toner therein. A toner supply roller 20 plays the role of a toner supplying member for supplying the fresh toner from the hopper 18 to the surface of the developing roller 16. A regulating roller 22 serves as a regulating member for leveling the toner deposited on the developing roller 16 to form a thin toner layer. A cleaning roller 24 scrapes remaining toner particles off the developing roller 16 after development. An agitator 26 conveys the toner from the hopper 18 to the toner supply roller 20 while agitating it. These components are individually journalled in the developing unit 14 and rotated as indicated by arrows in the figure.

The toner supply roller 20, regulating roller 22 and cleaning roller 24 are held in contact with the developing roller 16. The cleaning roller 24, toner supply roller 20 and regulating roller 22 are located one after another in this order with respect to the direction of rotation of the developing roller 16 and at predetermined distances. A developer supply region Y is defined in the portion where the toner supply roller 20 contacts the developing roller 16, while a regulating region Z is defined in the portion where the regulating roller 22 contacts the developing roller 16. Blades 28 and 30 are pressed against the regulating roller 22 and the cleaning roller 24, respectively. The blades 28 and 30 scrape toner particles off the associated rollers 22 and 24 by rubbing themselves against the latter.

Figure 5:
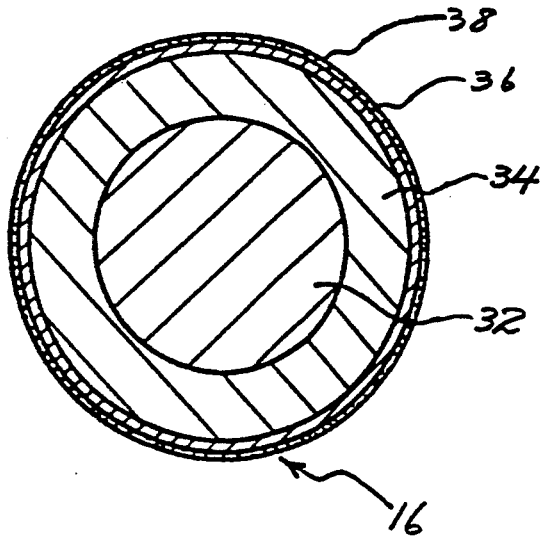
FIG. 5 is a section showing a specific construction of a developer carrier included in the device of FIG. 4.

As shown in FIG. 5, the developing roller 16 has a support 32 implemented as a roller-like metallic core. A base 34 is formed on the outer periphery of the support 32 and made of an elastic conductive material. A dielectric layer 36 is deposited on the base 34 and made of elastic fluorine-based resin. An electrode layer 38 is provided on the dielectric layer 36 and made of elastic fluorine-based resin in which conductive particles are dispersed without contacting one another. Part of the conductive particles distributed in the electrode layer 38 is exposed to the outside. Regarding the dielectric layer 36, use is made of a material having a predetermined specific inductive capacity. Specifically, the dielectric layer 36 is implemented by a material whose frequency characteristic is such that the ratio of the maximum specific inductive capacity to the minimum specific capacity in the frequency range of 50 mHz to 1 kHz is less than 2, as shown in any one of FIGS. 6, 7 and 8. The dielectric layer 36 is preferably but not limitatively made of a fluorine or silicone-based material. When the conductive base 34 is elastic, the dielectric layer 36 is made of a flexible material. This flexible material may be implemented with an alternative copolymer of fluoroolefin or alkylvinyl ether (for example, commercially available Lumiflon available from Asahi Glass or Seflal Coat, commercially available from Central Glass) or other similar elastic fluoric resin, vinyliden fluoride-based fluoric rubber or latex thereof (for example, Daiel Latex, commercially available from Daikin Kogyo) or similar fluoric rubber, or silicone-based elastic resin which has a major component of polydimethyl siloxane.

When the conductive base 42 is not made of an elastic material, the dielectric layer may be made, for example, of polytetrafluoroethylene, polychlorotrifluoroethylene, polyvinylidene fluoride, polyvinyl fluoride or similar fluoric resin, or a hard silicone resin.

What should be evident is this dielectric layer has the particular frequency characteristics as set forth above and is selected for its specific inductive capacity standpoint as a more important feature than its particular chemical make-up. The measurement of the frequency characteristics is what is important of the dielectric layer and this measurement can be made by conventional types of measuring arrangements. For example, a cylindrical electrode may be coaxially mounted on a roller and various AC bridge circuits may be connected thereto. The impedance can be measured with the AC frequency being sequentially changed. Based on the resulting data, the electrostatic capacity in the specific conductive capacity at each frequency may be calculated and an appropriate layer can be selected.

In operation, a latent image representative of a document is electrostatically formed on the drum 12 which has been uniformly charged beforehand. In the developing region X, the developing roller 16 of the developing device 10 selectively supplies the toner to the latent image to thereby develop it. In the developer supply region Y, the toner supply roller 20 feeds the fresh toner from the toner hopper 18 to the developing roller 16. Further, in the regulating region Z, the regulating roller 22 regulates the toner on the developing roller 16 into a layer having a predetermined thickness. The regulated toner layer is fed into the developing region X.

Figure 9:
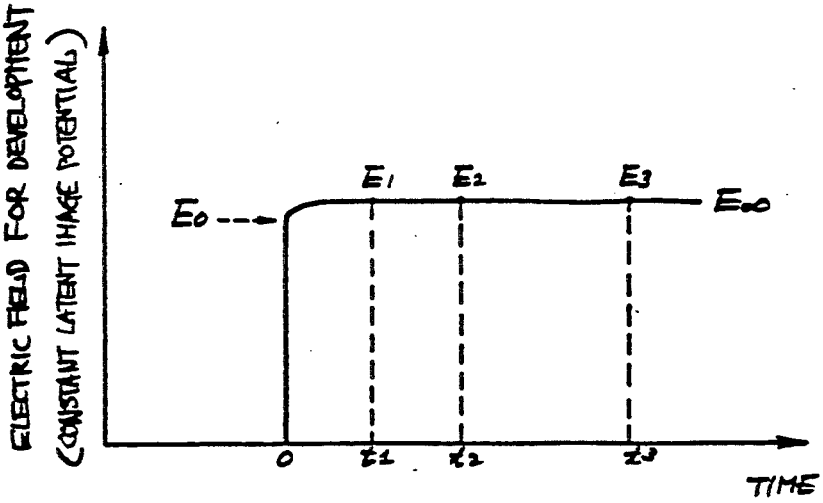
FIG. 9 is a graph showing a variation of an electric field in a developing region with respect to time achievable with the illustrative embodiment.

The dielectric layer 36 of the developing roller is formed of a material whose complex specific inductive capacity has a flat frequency characteristic. This insures a substantially constant developing characteristic with no regard to the developing linear velocity. More specifically, when the dielectric layer 36 is constituted by the material which suffers little from the influence of relaxation components as shown in FIG. 1, a dielectric field shown in FIG. 9 acts on the latent image shown in FIG. 2. The electric field of FIG. 9 is successful in maintaining the developing characteristic constant even if the developing linear velocity fluctuates. This kind of response characteristic is represented by integral calculus with respect to a continuous distribution of relaxing time constants and difficult to express in terms of a single time constant. In contrast, the frequency characteristic of the number portion of a complex specific inductive capacity which is the Fourier transform of a relaxing time characteristic can be accurately measured frequency component by frequency component. In the light of this, it was confirmed that a close relationship exists between the frequency characteristic of the real portion of a complex specific inductive capacity, i.e., the frequency characteristic of specific inductive capacities and the fluctuation of the developing characteristic.

Figure 6:
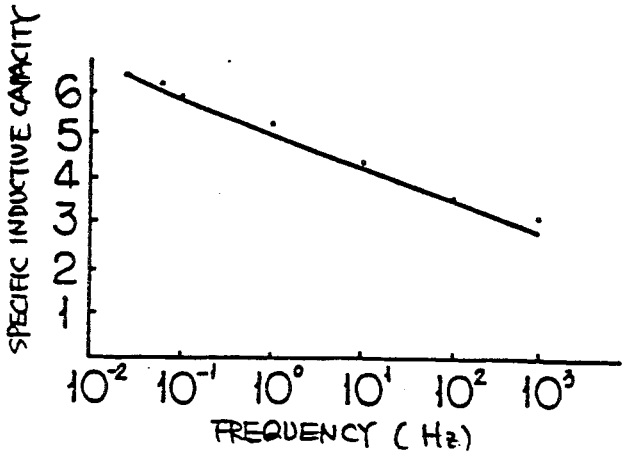
FIGS. 6 to 8 are graphs each showing a different specific inductive capacity to frequency characteristic applicable to the illustrative embodiment.
Figure 7:
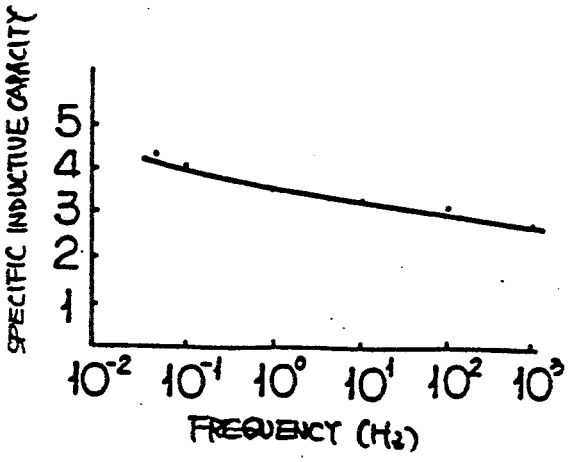
Figure 8:
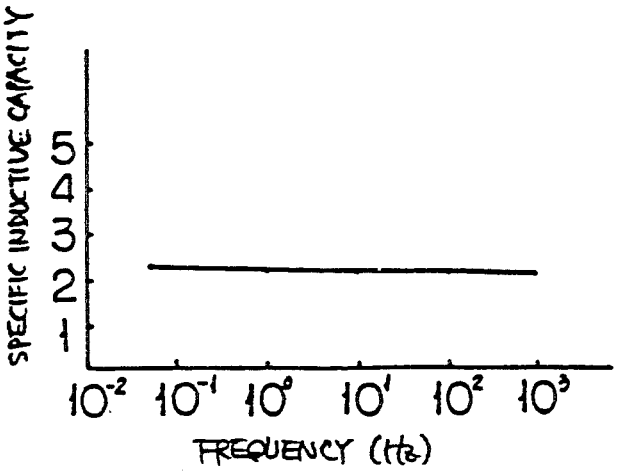
Figure 10:
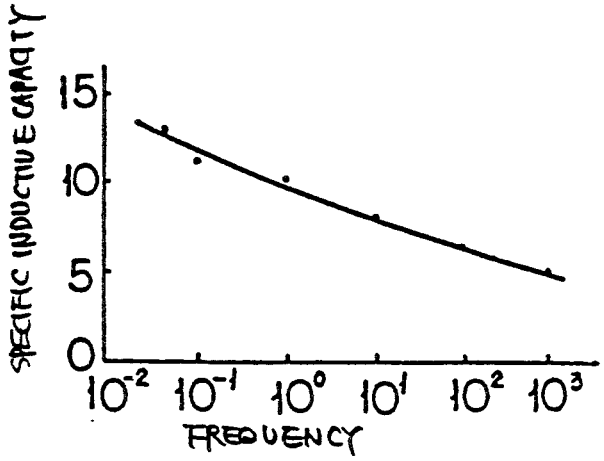
FIG. 10 PRIOR ART
FIG. 10 is a graph showing a prior art specific inductive capacity to frequency characteristic.
Figure 11:
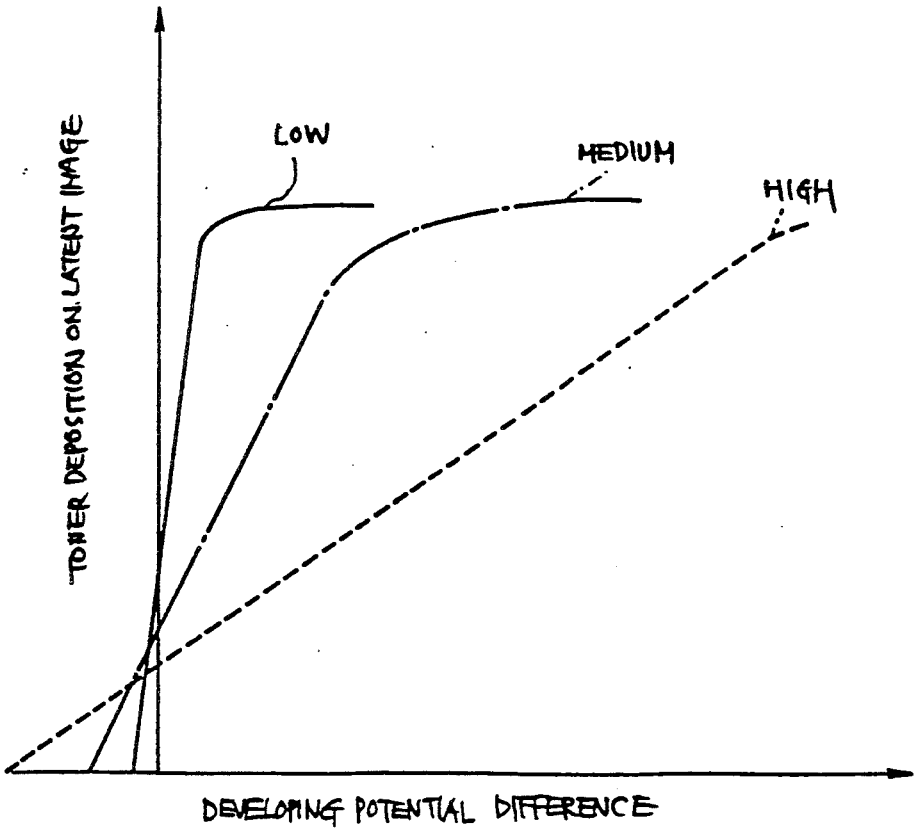
FIG. 11 PRIOR ART
FIGS. 11 and 12 are graphs each showing a different variation in the developing characteristic.
Figure 12:
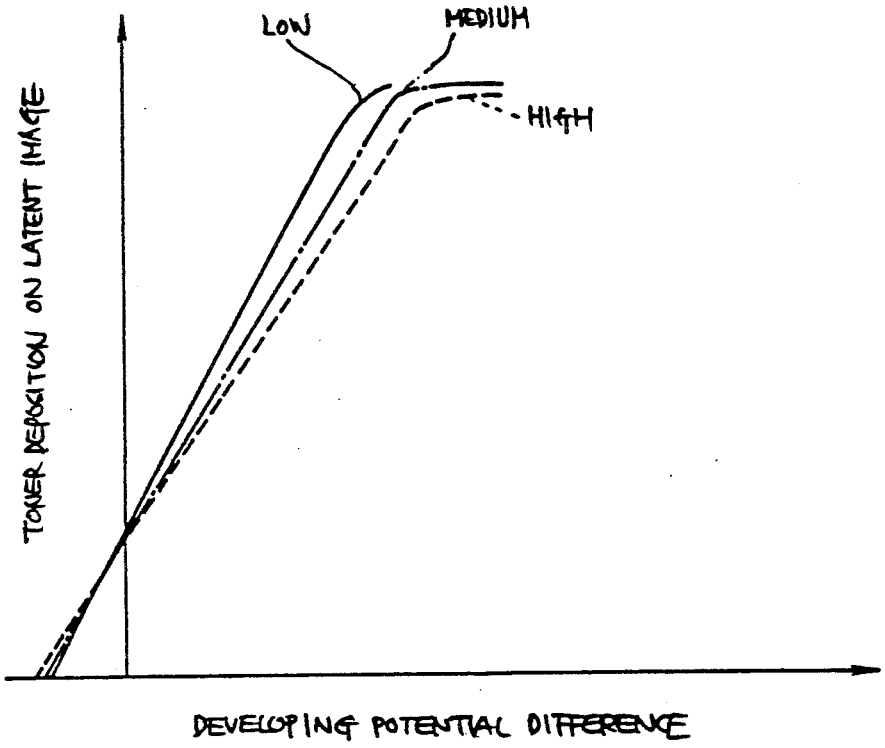

Experiments shows that when the dielectric layer 36 of the developing roller 16 is formed of resin in which the influence of relaxation components is noticeable as has been customary and as shown in FIG. 10, the amount of toner deposition on a latent image (ordinate) varies over a wide range in association with the developing linear velocity, as shown in FIG. 11. In FIG. 11, a solid curve, dash-and-dot curve, and dashed curve are representative of a low developing linear velocity, medium developing linear velocity, and a high developing linear velocity, respectively. Also, it was found that when the dielectric layer 36 is implemented by resin in which the influence of relaxation components is insignificant as in the illustrative embodiment and as shown in FIGS. 6 to 8, the amount of toner deposition on a latent image (ordinate) does not noticeably change despite the fluctuation of the developing linear velocity, as shown in FIG. 12. In FIG. 12, a solid curve, dash-and-dot curve and dashed curve are the same in meaning as those shown in FIG. 11. The frequency range of 50 mHz to 1 kHz which determines the complex specific inductive capacity is selected by taking account of the Fourier component particular to the variation of electric field with respect to time which is ascribable to the fact that, in practice, a line image or a solid image moves at a certain velocity relative to the developer carrier 16.

Figure 13:
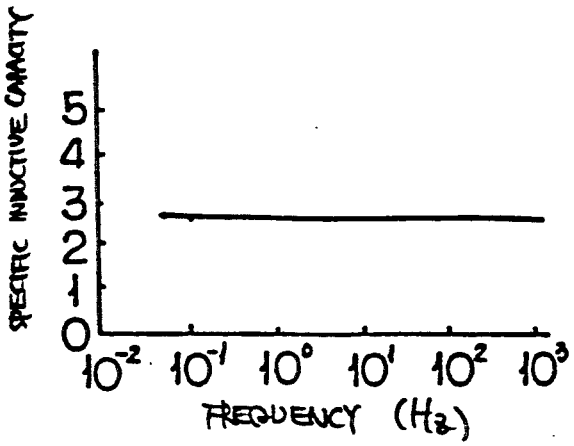
FIG. 13 is a graph showing another specific inductive capacity to frequency characteristic also applicable to the illustrative embodiment.
Figure 14:
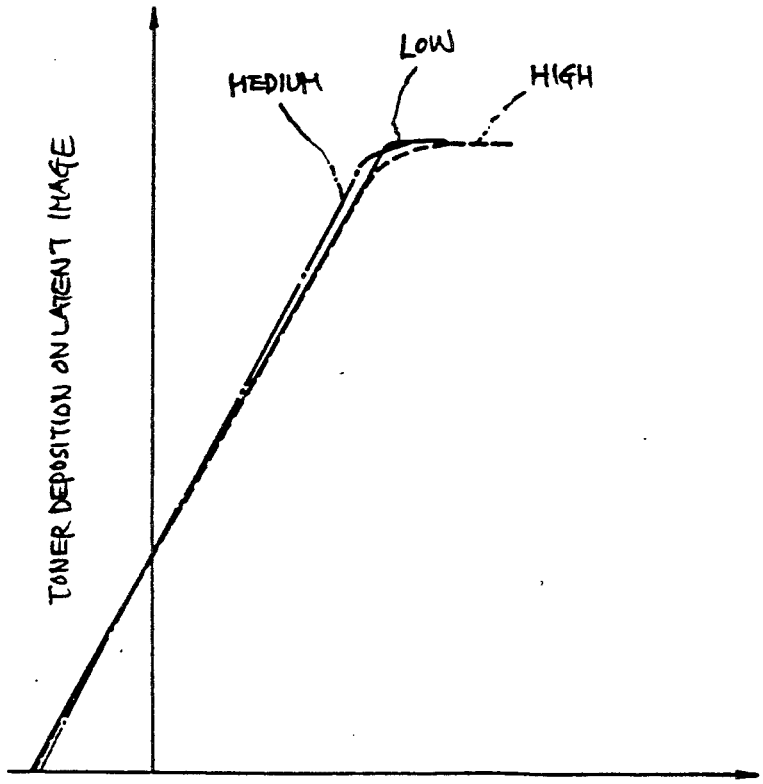
FIG. 14 is a graph showing another variation in the developing characteristic.

FIG. 13 is representative of a case wherein the dielectric layer 36 is formed of silicon-based resin which has an extremely stable frequency characteristic. As shown in FIG. 14, such a dielectric layer 36 allows the amount of toner deposition on a latent image to remain substantially the same at all the levels of developing linear velocity, i.e., at a lower linear velocity (solid curve), medium linear velocity (dash-and-dot curve), and high linear velocity (dashed curve).

Figure 15:
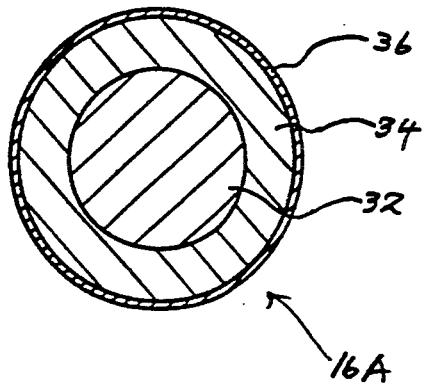
FIG. 15 is a section showing another specific construction of the developer carrier.

Referring to FIG. 15, another specific construction of the developer carrier is shown. The structural elements of FIG. 15 which are the same as the structural elements of FIG. 5 are designated by like reference numerals, and redundant description will be avoided for simplicity. In this alternative construction, the dielectric layer 36 and electrode layer 38 may be implemented by the same material or by different materials, as desired. Dielectrics applicable to the layers 36 and 38 can be firmly adhered by primer or plasma processing, for example. Regarding the electrode layer 38, dielectric layer 36 and base 34, use made be made of any one of elastic members and hard members.

The electric relaxation phenomenon discussed above is dependent on the relationship between the deformation, rotation and orientation of molecular chain and the intensity of electric field which are in turn closely related to the presence/absence of polar radical, symmetry of molecules, etc. Hence, materials the frequency characteristic of which is not flat change the frequency characteristic over a wide range in association with temperature, moisture and other environmental conditions also. Nevertheless, the materials whose specific inductive capacity does not vary beyond the previously stated particular range are successful in maintaining the developing characteristic in the allowable range against the environmental conditions.

In summary, it will be seen that the present invention provides a developing device which is operable in a desirable manner by confining the fluctuation of developing characteristic ascribable to that of developing linear speed in a predetermined range without resorting to the actual measurement of a response characteristic of a developer carrier. This is derived from the fact that a dielectric layer forming part of the developer carrier and closely related to the fluctuation of developing characteristic has a frequency characteristic which is confined in a predetermined range.

Various modifications will become possible for those skilled in the art after receiving the teachings of the present disclosure without departing from the scope thereof.

What is claimed is:

1. In a developing device for an image forming apparatus which comprises:

a developer carrier comprising a dielectric layer for forming an electric field for development and for causing said developer carrier to retain and convey a developer to a developing region where a latent image is electrostatically formed on an image carrier which is to be developed by said developer;

wherein said developer carrier is comprised of a dielectric layer formed of a material having a frequency characteristic such that a ratio of a maximum specific inductive capacity to a minimum specific inductive capacity in a frequency range of 50 mHz to 1 kHz is smaller than a predetermined value.

2. A developing device as claimed in claim 1, wherein said predetermined value is 2.

3. A developing device as claimed in claim 2, wherein said dielectric layer comprises elastic fluorine-based resin.

4. A developing device as claimed in claim 3, wherein said developer carrier further comprises an electrode layer provided on said dielectric layer and formed by dispersing conductive particles in elastic fluorine resin at spaced positions.

5. In a developing device for an image forming apparatus which comprises:

a developer carrier comprising a dielectric layer for forming an electric field for development and for causing said developer carrier to retain and convey a developer to a developing region where a latent image is eletrostatically formed on an image carrier which is to be developed by said developer;

wherein said developer carrier is comprised of a dielectric layer formed of a material having a frequency characteristic such that a ratio of a maximum specific inductive capacity to a minimum specific inductive capacity in a frequency range of 50 mHz to 1 kHz is smaller that a predetermined value, and wherein said predetermined value is 2.

* * * * *

UNITED STATES PATENT AND TRADEMARK OFFICE

CERTIFICATE OF CORRECTION

PATENT NO. : 5,136,335

DATED : August 4, 1992

INVENTOR(S) : Fuchio Takeda et al.

It is certified that error appears in the above-identified patent and that said Letters Patent is hereby corrected as shown below:

On the Title Page,

Item [63], the Related U.S. Application Data has been omitted, should be, --Continuation-in-part of Ser. No. 461,000, Jan.4, 1990, abandoned--.

Signed and Sealed this

Twenty-first Day of September, 1993

Bruce Lehman

*Attest:*

BRUCE LEHMAN

*Attesting Officer*

*Commissioner of Patents and Trademarks*